US011286959B2

(12) United States Patent
Robens

(10) Patent No.: US 11,286,959 B2
(45) Date of Patent: Mar. 29, 2022

(54) ACCUMULATOR MODULE FOR HYDROMECHANICAL SPRING-LOADED DRIVE

(71) Applicant: Hitachi Energy Switzerland AG, Baden (CH)

(72) Inventor: Niko Robens, Hofheim am Taunus (DE)

(73) Assignee: Hitachi Energy Switzerland AG, Baden (CH)

( * ) Notice: Subject to any disclaimer, the term of this patent is extended or adjusted under 35 U.S.C. 154(b) by 0 days.

(21) Appl. No.: 16/063,835

(22) PCT Filed: Dec. 7, 2016

(86) PCT No.: PCT/EP2016/080029
§ 371 (c)(1),
(2) Date: Jun. 19, 2018

(87) PCT Pub. No.: WO2017/108403
PCT Pub. Date: Jun. 29, 2017

(65) Prior Publication Data

US 2018/0372125 A1 Dec. 27, 2018

(30) Foreign Application Priority Data

Dec. 23, 2015 (DE) ..... 202015107048.9
Jan. 29, 2016 (DE) ..... 202016100443.8

(51) Int. Cl.
*H01H 33/34* (2006.01)
*F15B 1/24* (2006.01)
(Continued)

(52) U.S. Cl.
CPC ..... *F15B 1/24* (2013.01); *H01H 3/24* (2013.01); *H01H 3/301* (2013.01); *H01H 33/34* (2013.01);
(Continued)

(58) Field of Classification Search
CPC ..... H01H 3/24; H01H 3/301; H01H 33/30; H01H 33/32; H01H 33/34; H01H 33/40;
(Continued)

(56) References Cited

U.S. PATENT DOCUMENTS 2,765,731 A * 10/1956 Edwards ..... B30B 3/04 100/99
3,168,301 A * 2/1965 Allinquant ..... F16J 1/12 267/124
(Continued)

FOREIGN PATENT DOCUMENTS

CN 101896380 A 11/2010
CN 103097745 A 5/2013
(Continued)

OTHER PUBLICATIONS

European Patent Office, International Search Report for PCT/EP2016/080029, dated Apr. 18, 2017, 7 pages (including translation).
(Continued)

*Primary Examiner* — Dustin T Nguyen
(74) *Attorney, Agent, or Firm* — Sage Patent Group

(57) ABSTRACT

The invention relates to an accumulator module for a hydromechanical spring-loaded drive, wherein the spring-loaded drive is provided to actuate a high-voltage power switch (12), and wherein the accumulator module contains a pressure-tight housing (1), an accumulator piston (2) which protrudes into the housing (1) and is axially moveable in the housing (1), and a sealing cover (4) which seals the housing in an pressure-tight manner. In addition, at least one connecting channel (5, 6) is provided, which is introduced into the housing (1) for transporting a highly pressurised fluid present between the inner wall (7) of the housing and the head (3) of the accumulator piston to a high-pressure channel (11) of the spring-loaded drive, which channel is outside the housing. In order to increase the service life of
(Continued)

the accumulator module, at least one pressure relief groove (8) is circumferentially applied to the head (3) of the accumulator piston.

18 Claims, 2 Drawing Sheets

(51) Int. Cl.
*H01H 3/24* (2006.01)
*H01H 3/30* (2006.01)
*H01H 33/40* (2006.01)

(52) U.S. Cl.
CPC ..... *H01H 33/40* (2013.01); *F15B 2201/21* (2013.01); *F15B 2201/31* (2013.01); *F15B 2201/312* (2013.01); *F15B 2201/413* (2013.01)

(58) Field of Classification Search
CPC ..... F15B 2201/21; F15B 2201/31; F16J 1/08; F16J 1/09
See application file for complete search history.

(56) References Cited

U.S. PATENT DOCUMENTS

| | | | | |
|---|---|---|---|---|
| 3,559,538 | A | 2/1971 | Holder | |
| 4,425,836 | A * | 1/1984 | Pickrell | F15B 15/224 91/405 |
| 4,461,322 | A * | 7/1984 | Mills | F15B 1/24 138/31 |
| 4,716,812 | A | 1/1988 | Koerner et al. | |
| 5,051,063 | A * | 9/1991 | Vasselet | G05D 16/2066 303/59 |
| 5,624,105 | A | 4/1997 | Runkel | |
| 6,216,457 | B1 * | 4/2001 | Lubbers | B60T 7/042 60/547.2 |
| 8,656,959 | B2 * | 2/2014 | Marin | F15B 1/04 138/30 |
| 9,388,902 | B2 | 7/2016 | Sueyoshi et al. | |
| 9,620,302 | B2 | 4/2017 | Schmidt et al. | |
| 9,790,962 | B2 | 10/2017 | Robson | |
| 2010/0287923 | A1 | 11/2010 | Bareiss et al. | |
| 2013/0113165 | A1 | 5/2013 | Sueyoshi et al. | |
| 2013/0277190 | A1 * | 10/2013 | Schmidt | H01H 3/24 200/400 |
| 2014/0290972 | A1 | 10/2014 | Robson | |
| 2015/0337869 | A1 | 11/2015 | Pakarsky et al. | |
| 2018/0066680 | A1 | 3/2018 | Robson | |

FOREIGN PATENT DOCUMENTS

| | | | |
|---|---|---|---|
| CN | 103250222 | A | 8/2013 |
| CN | 103958902 | A | 7/2014 |
| CN | 104747534 | A | 7/2015 |
| CN | 105090137 | A | 11/2015 |
| DE | 3408909 | A1 | 9/1985 |
| DE | 102010054665 | B3 | 2/2012 |
| DE | 102011120895 | A1 | 4/2012 |
| EP | 0829892 | A1 | 3/1998 |
| KR | 20140009254 | A | 1/2014 |
| WO | 9408808 | A1 | 4/1994 |

OTHER PUBLICATIONS

European Patent Office, Written Opinion of the Searching Authority for PCT/EP2016/080029, dated Apr. 18, 2017, 13 pages (including translation).
European Patent Office, International Preliminary Report on Patentability for PCT/EP2016/080029, dated Jun. 26, 2018, 15 pages (including translation).
K. Schlemmer et al., "Conceptual Methods for the Pressure Relief in Valve Pistons," O+P 1-2/2007, pp. 2-9, with machine translation appended.

* cited by examiner

ACCUMULATOR MODULE FOR HYDROMECHANICAL SPRING-LOADED DRIVE

CROSS-REFERENCE TO RELATED APPLICATIONS

This application is a U.S. national stage of International Application Serial No. PCT/EP2016/080029, filed Dec. 7, 2016, which claims priority to German Patent Application No. 20 2016 100 443.8, filed Jan. 29, 2016, and to German Patent Application No. 20 2015 107 048.9, filed Dec. 23, 2015. The entire disclosures of each of the foregoing applications are hereby incorporated by reference.

TECHNICAL FIELD

The invention relates to a hydraulic accumulator module for a hydromechanical spring-loaded drive, wherein the spring-loaded drive is provided for activating a high-voltage or medium-voltage power switch. High-voltage herein is understood to be the voltage range above 50 kV, while medium-voltage is considered to be the range between 1 and 50 kV.

BACKGROUND

A hydromechanical spring-loaded drive for activating a high-voltage power switch is known, for example, from EP 0829892 B1. The drive described therein includes a central piston/cylinder assembly by means of which the high-voltage power switch is activated. The central piston/cylinder assembly is surrounded by a laminated disk spring which is clamped between a thrust collar that is movable axially in relation to the cylinder and a fixedly disposed support collar. In order for the laminated disk spring to be tensioned, the thrust collar is moved in the direction of the support collar by means of three hydraulic accumulator modules which in the circumferential direction are distributed around the central cylinder and disposed above the thrust collar. The accumulator modules include in each case one accumulator piston which is moved in a pressure cylinder and are filled with a highly pressurized fluid. If the high-voltage power switch is to be opened, that is to say the piston in the central piston/cylinder assembly is to be moved into the latter, the spring force of the laminated disk spring supports this procedure in that the laminated spring acts on the thrust collar such that the accumulator pistons are moved into the accumulator modules. The highly pressurized fluid that is present in the accumulator modules is conveyed in the direction of the central piston on account thereof, where said fluid reinforces the movement of the piston away from the power switch.

An accumulator module for a hydromechanical spring-loaded drive is known from DE 10 2010 054 665 B3, wherein the spring-loaded drive operates according to the same fundamental principle as said spring-loaded drive described in EP 0829892 B1. The accumulator module again includes an accumulator piston and a pressure cylinder, wherein the highly pressurized fluid that is present in the pressure cylinder by way of bores that are incorporated in the accumulator piston head and by way of two part-ducts that are disposed in the cylinder wall of the accumulator module is conveyable into a high-pressure duct. The two part-ducts herein are connected parallel to one another to the high-pressure duct. Said part-ducts are also referred to as high-pressure connectors. The high-pressure duct in turn is connected to the hydraulic system of the central piston/cylinder assembly of the spring-loaded drive. The accumulator pistons and the part-ducts of the accumulator module are mutually disposed such that the accumulator piston, as from a predefined stroke, closes a first of the two part-ducts. In this way, stroke-dependent throttling is achieved in DE 10 2010 054 665 B3, that is to say that the fluid as from the predefined stroke makes its way from the accumulator module into the hydraulic system of the central piston/cylinder assembly only by way of one instead of both part-ducts.

Manifestations of wear on the accumulator piston head have now been observed during the operation of hydromechanical spring-loaded drives having one or a plurality of the accumulator modules described in DE 10 2010 054 665 B3 in that the guide strip that is attached to the circumference of the accumulator piston head has been mechanically subtracted. The remnants of the worn guide strip that remain in the pressure cylinder represent abrasive particles which in turn lead to wear on the seals and thus could cause an undesirable leakage of the accumulator module. Furthermore, said particles can make their way into the system by way of the high-pressure connector and cause further damage, for example to the switch valve.

SUMMARY

It is an object of the invention to specify an accumulator module for a hydromechanical spring-loaded drive for activating a high-voltage or a medium-voltage power switch, in which the issue of wear described has been remedied.

The present achievement of the object is based on the following fundamental aspects.

When wear arises on the first part-duct, that is to say on one of the two high-pressure connectors, the accumulator piston head in relation to the cylinder wall acts like a slide valve and is consequently subject to similar effects. The following effect herein has disadvantageous consequences: On account of a deviation of the pressure cylinder, or of the accumulator piston, respectively, from the ideal geometric shape, for example as a result of an asymmetrical incident flow and/or of production tolerances, unbalanced pressure fields are created in the seal gaps between the accumulator piston head and the cylinder wall. The accumulator piston head can be urged from the central position on account of said pressure fields, on account of which non-uniform wear arises on the accumulator piston head, and in particular on any existing guide strip of the accumulator piston head. As a consequence thereof, the accumulator piston head in the course of the operating lifespan bears ever closer, or more obliquely, respectively, on the high-pressure connectors and thus modifies the hydraulic flow losses during the switching procedures of the spring-loaded drive. There is accordingly the risk of the remnants of the worn accumulator piston head, or of the guide strip, respectively, becoming abrasive particles, on the one hand, which can lead to further manifestations of wear also on other components of the accumulator module and of the remaining drive, this ultimately leading to potential leakages. On the other hand, it has been recognized that the hydraulic flow losses that by virtue of the wear on the accumulator module are variable over the operating lifespan can also lead to a modified effect of the stroke-dependent throttling to be initiated by the closing of the one part-duct.

The understanding that the accumulator piston head in relation to the cylinder wall behaves like a slide valve has led to the discovery of a professional article with the title "Conceptual methods for the pressure relief in valve pistons" by K. Schlemmer and H. Murrenhoff, O+P 1-2/2007, pages 2-9. It is described in this article that the friction forces between the valve slide and the valve sleeve resulting from production tolerances and consequential unbalanced pressure fields can lead to blocking of the valve slide, and that this problem can be remedied by incorporating pressure-relief grooves on the circumference of the valve slide.

The object of the present invention is achieved by an accumulator module having the features according to independent claim 1.

The starting point is an accumulator, known from the prior art, for a hydromechanical spring-loaded drive, wherein the spring-loaded drive is provided for activating a high-voltage power switch. The accumulator module in a known manner includes a pressure-tight housing, an accumulator piston that protrudes into the housing and is axially movable in the housing, a closure cover that closes the housing in a pressure-tight manner, and at least one connection duct, incorporated in the housing, for conveying a highly pressurized fluid that is located between an inner wall of the housing and a head of the accumulator piston to a high-pressure duct of the spring-loaded drive, said high-pressure duct being located outside the housing.

According to the invention at least one pressure-relief groove is attached in an encircling manner on the head of the accumulator piston. The at least one pressure-relief groove ensures that an equalization of pressure can take place in the radial direction of the accumulator piston such that any urging of the head of the accumulator piston from the central position is reduced to the extent that any wear on the head or the guide strip, respectively, is avoided. Moreover, in the special case of the presence of more than one connection duct it is ensured that the desired stroke-dependent throttling is achieved in a manner so as to be unmodified over the operating lifespan of the accumulator module. The at least one pressure-relief groove herein can be incorporated on the accumulator piston head in the circumferential direction or else in a helical manner, and the cross section of said pressure-relief groove can have any arbitrary geometric shape.

In one preferred embodiment of the invention at least two pressure-relief grooves of the same geometric design embodiment are incorporated in the head of the accumulator piston, so as to run in the circumferential direction of said head and so as to have the same spacing from one another. The at least two pressure-relief grooves designed in this manner improve the pressure-relief effect as compared to only a single groove, or else as compared to grooves that are of a non-homogeneous design and/or are distributed in a non-homogeneous manner.

In a further design embodiment of the accumulator module the latter has at least one through bore which is incorporated in the head of the accumulator piston and through which the fluid that is located between the inner wall of the housing and the head of the accumulator piston can flow to the connection duct. Instead of a through bore, grooves or notches that are located on the outside of the accumulator piston head could also serve as a hydraulic connection path to the connection duct. A connection path of this type is necessary when the opening of the connection duct does not open into the housing base, or into the housing of the accumulator module at the height of the housing base, respectively, but only at some distance of said housing base.

In a special design embodiment of the accumulator module a guide strip is fastened in the circumferential direction to the circumference of the head of the accumulator piston, said guide strip potentially being located above as well as below, or to the left or to the right of the pressure-relief grooves and herein preferably running so as to be parallel to the latter. In a further special design embodiment, the closure cover guides the accumulator piston in the axial direction of the latter.

BRIEF DESCRIPTION OF THE DRAWINGS

The invention and a potential design embodiment will be explained and described in more detail by means of the figures hereunder.

In the figures.

DETAILED DESCRIPTION OF THE DRAWINGS

Figure 1:
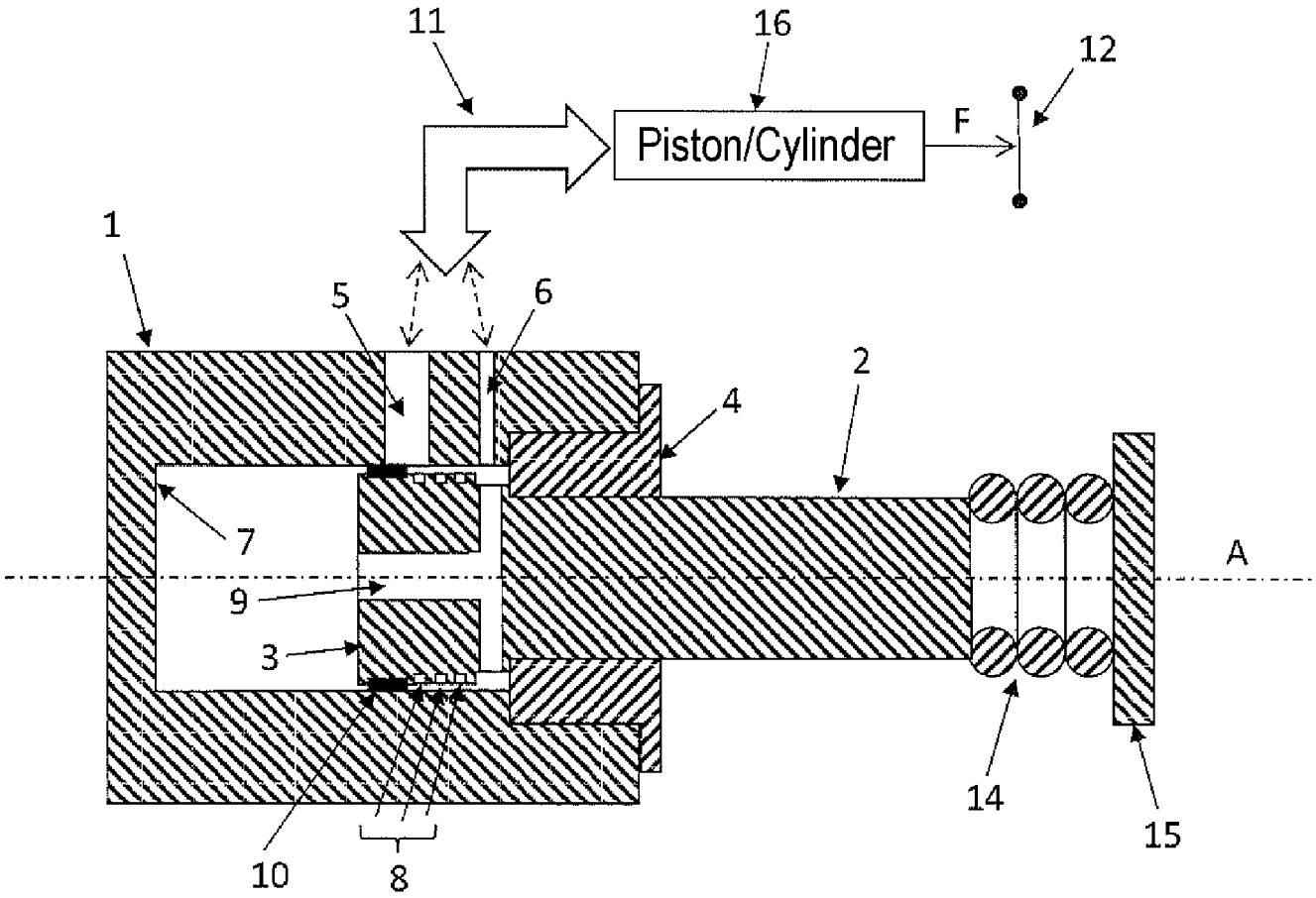
FIG. 1 shows an accumulator module having pressure-relief grooves in the case of a charged spring accumulator and of a closed high-voltage power switch.

An accumulator module for a hydromechanical spring-loaded drive can be seen in FIG. 1. The spring-loaded drive herein is provided for activating a high-voltage power switch 12 and includes one or else a plurality of the accumulator module illustrated in FIG. 1. The spring-loaded drive moreover includes a hydraulically activated piston/cylinder assembly 16, indicated in FIG. 1, which mechanically acts directly on the high-voltage power switch 12 and exerts on the latter a closing force or opening force F, respectively. The hydraulic activation of the piston/cylinder assembly 16 is performed by way of a hydraulic system which is part of the spring-loaded drive and which comprises at least one high-pressure duct 11. A spring accumulator 14 which in FIG. 1 is illustrated as a coil spring is furthermore part of the spring-loaded drive. Alternatively, other types of springs such as, for example, disk springs, can also be used. The spring accumulator 14 here is in the charged state, that is to say the compressed state, wherein the coil spring is pressed against a stationary bearing face 15.

The accumulator module of FIG. 1 includes a pressure-tight housing 1, an accumulator piston 2 which protrudes into the housing 1 and is movable axially (along the longitudinal axis of said accumulator piston 2) in the housing 1, a closure cover 4 which axially guides the accumulator piston 2 and closes the housing in a pressure-tight manner, and two connection ducts 5, 6, incorporated in the housing 1, for conveying a highly pressurized fluid that is located between the inner wall 7 of the housing and the head 3 of the accumulator piston to the high-pressure duct 11 of the spring-loaded drive, said high-pressure duct 11 being located outside the housing. The fluid is preferably hydraulic oil. A total of three pressure-relief grooves 8 are attached in an encircling manner on the head 3 of the accumulator piston. The three pressure-relief grooves 8 of the same geometric design embodiment herein run along the circumferential direction of the head 3 of the accumulator piston so as to have the same spacing from one another.

The tip of the reference arrow of reference sign 7 in FIG. 1 not only points toward the inner wall of the housing 1 but at the same time also toward the inner wall of the housing base. Since the connection ducts 5 and 6 are located as a significant distance from the housing base, a hydraulic connection toward said connection ducts 5 and 6 has to be provided in order for the fluid to be able to escape from the space between the inner wall 7 and the head 3 of the accumulator piston when the accumulator piston 2 moves into the housing 1. In this example, connection duct 6 is narrower than connection duct 5. For this purpose, the head 3 of the accumulator piston has a through bore 9 which is designed in a T shape.

A guide strip 10 which is composed of PTFE (polytetrafluoroethylene) and runs so as to be parallel with the pressure-relief grooves 8 is fastened to the circumference of the head 3 of the accumulator piston 2 in the circumferential direction. By virtue of the pressure-relief grooves 8, pressure differentials within the housing 1, between the zones located above the axis A and close to the connection ducts 5, 6, and the zones that are located below the axis A and thus at the opposite side of the accumulator piston 2, are prevented. Since the pressure conditions on either side of the axis A are thus balanced, the head 3 of the accumulator piston 2 is no longer urged from the central position, such that wear on the guide strip 10 is avoided.

Figure 2:
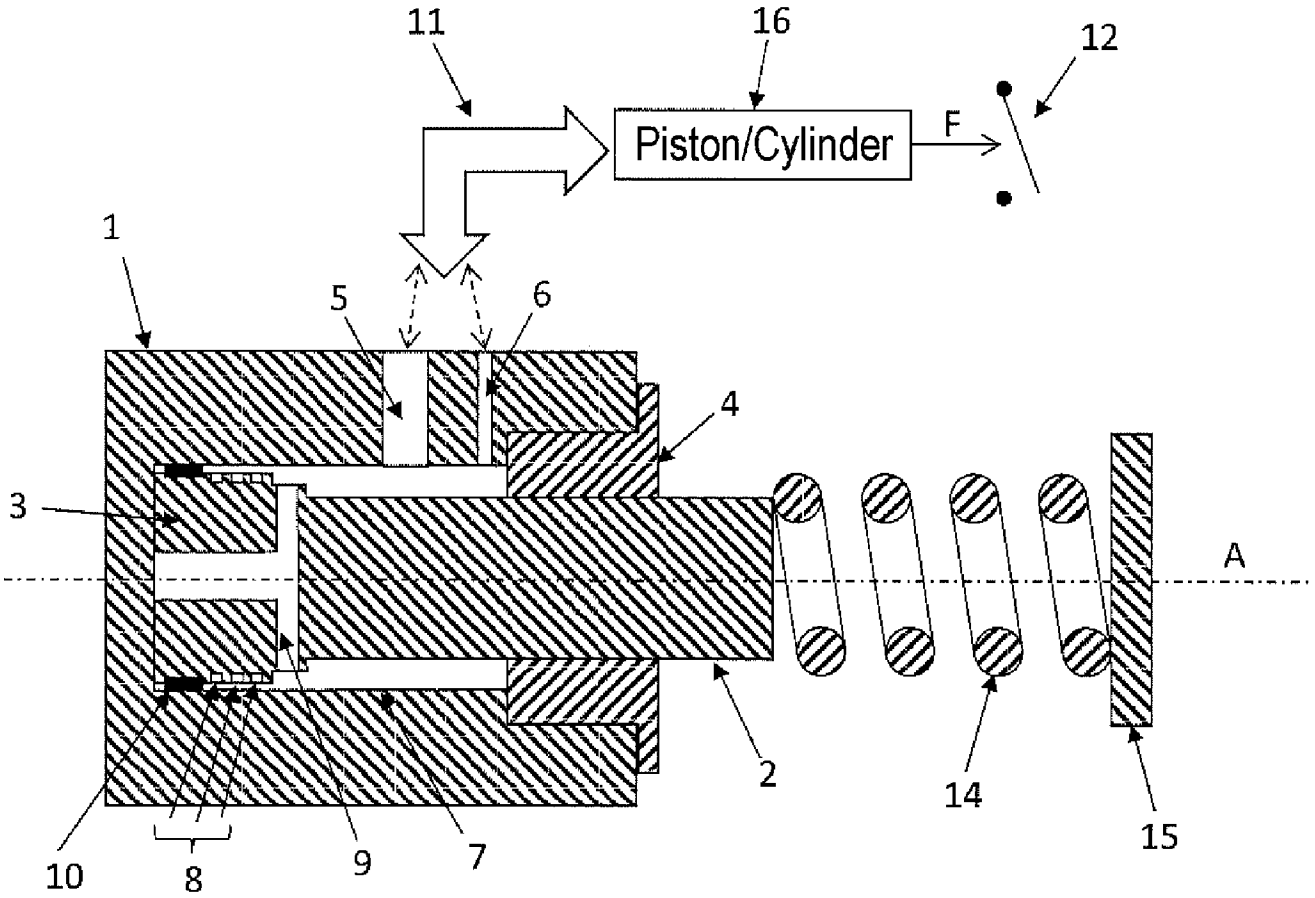
FIG. 2 shows the accumulator module from FIG. 1 in the case of a discharged spring accumulator and of an opened high-voltage power switch.

By contrast to FIG. 1, FIG. 2 shows the high-voltage power switch 12 in the opened position. The spring accumulator 14 is discharged during the opening of the high-voltage power switch 12, so as to provide additional opening energy. The coil spring is relaxed when the spring accumulator 14 is being discharged, on account of which the accumulator piston 2 is moved into the housing 1. The highly pressurized fluid herein is moved through the through bore 9 in the direction of the connection ducts 5 and 6, and from there is conveyed in the direction of the high-pressure duct 11 where said fluid acts on the piston/cylinder assembly so that the opening procedure of the high-voltage power switch 12 is accelerated. The accumulator module in FIG. 2 is shown at the end of the opening procedure, when the head 3 of the accumulator piston 2 has reached the housing base, that is to say when the accumulator piston 2 has been fully retracted into the housing 1.

The invention claimed is:

1. An accumulator module comprising:

a pressure-tight housing;

an accumulator piston that protrudes into the housing and is axially movable in the housing between a first end of the housing and a second end of the housing, the accumulator piston comprising:

a head having a first diameter;

the head comprising a terminal surface facing towards the second end of the housing and a circumference peripherally connected with the terminal surface;

a guide strip fastened to the circumference of the head, the guide strip having a second diameter greater than the first diameter, the guide strip configured to contact an inner wall of the housing during an operation of the accumulator module to maintain a gap between the circumference of the head and the inner wall, the inner wall having a third diameter greater than the first diameter; and at least one pressure-relief groove in the head, the at least one pressure-relief groove disposed around the circumference of the head;

a closure cover that closes the first end of the housing in a pressure-tight manner; and a pair of connection ducts in the housing, for conveying a highly pressurized fluid to a high-pressure duct located outside the housing, such that the highly pressurized fluid is located in the gap between the inner wall of the housing and the head of the accumulator piston during the operation of the accumulator module, and such that the guide strip is maintained between the second end of the housing and the pair of connection ducts when the accumulator piston is in contact with the first end of the housing, the pair of connection ducts comprising a first connection duct maintained between the first end of the housing and the at least one pressure-relief groove during the entire operation of the accumulator module, and a second connection duct located between the second end of the housing and the at least one pressure-relief groove during a portion of the operation of the accumulator module, the guide strip fastened to the circumference of the head in between the terminal surface of the head and the at least one pressure-relief groove, the accumulator piston further comprising a single through-bore comprising an axial bore portion and a radial bore portion, the axial bore portion axially traversing into the terminal surface of the head and extending on a longitudinal axis of the accumulator piston, the radial bore portion radially traversing through the circumference of the head and not traversing into the at least one pressure-relief groove, the axial bore portion substantially perpendicular to the radial bore portion and in fluid communication with the axial bore portion, the axial bore portion configured to allow the highly pressurized fluid to flow between a base of the housing and the radial bore portion, the radial bore portion configured to allow the highly pressurized fluid to flow between the axial bore portion and the pair of connection ducts, and the at least one pressure-relief groove positioned in between the guide strip and the radial bore portion, so as to maintain the pressure-relief effect provided by the at least one pressure-relief groove.

2. The accumulator module as claimed in claim 1, wherein the at least one pressure-relief groove comprises at least two pressure-relief grooves of the same geometric design in the head of the accumulator piston, so as to run in a circumferential direction of said head and so as to have the same spacing from one another.

3. The accumulator module as claimed in claim 1, wherein the guide strip is disposed so as to be parallel with the at least one pressure-relief groove.

4. The accumulator module as claimed in claim 1, wherein the guide strip comprises polytetrafluoroethylene.

5. The accumulator module as claimed in claim 1, wherein the guide strip in relation to the at least one pressure-relief groove is disposed on the head of the accumulator piston so as to be disposed within the housing between the at least one pressure-relief groove and the second end of the housing.

6. The accumulator module as claimed in claim 1, wherein the closure cover is configured to axially guide the accumulator piston.

7. The accumulator module as claimed in claim 1, wherein a first distance between one of the pair of connection ducts and the closure cover is less than a second distance between the at least one pressure-relief groove and the closure cover during the operation of the accumulator module.

8. The accumulator module as claimed in claim 1, wherein the second connection duct is between the first end of the housing and the at least one pressure-relief groove during another portion of the operation of the accumulator module.

9. The accumulator module as claimed in claim 1, wherein the first connection duct of the pair of connection ducts is narrower than the second connection duct of the pair of connection ducts.

10. The accumulator module as claimed in claim 9, wherein the first connection duct is located between the second connection duct and the first end of the housing.

11. A hydromechanical spring-loaded drive comprising:

an accumulator module for activating a high-voltage power switch, wherein the accumulator module includes:

a pressure-tight housing;

an accumulator piston that protrudes into the housing and is axially movable in the housing between a first end of the housing and a second end of the housing, the accumulator piston comprising:

a head having a first diameter;

the head comprising a terminal surface facing towards the second end of the housing and a circumference peripherally connected with the terminal surface;

a guide strip fastened to the circumference of the head, the guide strip having a second diameter greater than the first diameter, the guide strip configured to contact an inner wall of the housing during an operation of the accumulator module to maintain a gap between the circumference of the head and the inner wall, the inner wall having a third diameter greater than the first diameter; and at least one pressure-relief groove in the head, the at least one pressure-relief groove disposed around the circumference of the head;

a closure cover that closes the first end of the housing in a pressure-tight manner;

a pair of connection ducts in the housing, for conveying a highly pressurized fluid to a high-pressure duct located outside the housing, such that the highly pressurized fluid is located in the gap between the inner wall of the housing and the head of the accumulator piston during the operation of the accumulator module, and such that the guide strip is maintained between the second end of the housing and the pair of connection ducts when the accumulator piston is in contact with the first end of the housing; and a spring accumulator coupled to the piston, the guide strip fastened to the circumference of the head in between the terminal surface of the head and the at least one pressure-relief groove, the accumulator piston further comprising a single through-bore comprising an axial bore portion and a radial bore portion, the axial bore portion axially traversing into the terminal surface of the head and extending on a longitudinal axis of the accumulator piston, the radial bore portion radially traversing through the circumference of the head and not traversing into the at least one pressure-relief groove, the axial bore portion substantially perpendicular to the radial bore portion and in fluid communication with the axial bore portion, the axial bore portion configured to allow the highly pressurized fluid to flow between a base of the housing and the radial bore portion, the radial bore portion configured to allow the highly pressurized fluid to flow between the axial bore portion and the pair of connection ducts, and the at least one pressure-relief groove positioned in between the guide strip and the radial bore portion, so as to maintain the pressure-relief effect provided by the at least one pressure-relief groove.

12. The hydromechanical spring-loaded drive as claimed in claim 11, wherein the at least one pressure-relief groove comprises at least two pressure-relief grooves of the same geometric design in the head of the accumulator piston, so as to run in a circumferential direction of said head and so as to have the same spacing from one another.

13. The hydromechanical spring-loaded drive as claimed in claim 11, wherein the guide strip in relation to the at least one pressure-relief groove is disposed on the head of the accumulator piston so as to be disposed within the housing between the at least one pressure-relief groove and the second end of the housing.

14. The hydromechanical spring-loaded drive as claimed in claim 11, wherein the closure cover is configured to axially guide the accumulator piston.

15. The hydromechanical spring-loaded drive as claimed in claim 11, wherein a first distance between one of the pair of connection ducts and the closure cover is less than a second distance between the at least one pressure-relief groove and the closure cover during the operation of the accumulator module.

16. The hydromechanical spring-loaded drive as claimed in claim 11, wherein one of the pair of connection ducts is maintained between the first end of the housing and the at least one pressure-relief groove during the entire operation of the accumulator module, and the other of the pair of connection ducts is located between the second end of the housing and the at least one pressure-relief groove during a portion of the operation of the accumulator module.

17. The hydromechanical spring-loaded drive as claimed in claim 16, wherein the other of the pair of connection ducts is between the first end of the housing and the at least one pressure-relief groove during another portion of the operation of the accumulator module.

18. An accumulator module comprising:

a pressure-tight housing;

an accumulator piston that protrudes into the housing and is axially movable in the housing between a first end of the housing and a second end of the housing, the accumulator piston comprising:

a head having a first diameter;

the head comprising a terminal surface facing towards the second end of the housing and a circumference peripherally connected with the terminal surface;

a guide strip fastened to the circumference of the head, the guide strip having a second diameter greater than the first diameter, the guide strip configured to contact an inner wall of the housing during an operation of the accumulator module to maintain a gap between the circumference of the head and the inner wall, the inner wall having a third diameter greater than the first diameter; and at least one pressure-relief groove in the head, the at least one pressure-relief groove disposed around the circumference of the head;

a closure cover that closes the first end of the housing in a pressure-tight manner; and a pair of connection ducts in the housing, for conveying a highly pressurized fluid to a high-pressure duct located outside the housing, such that the highly pressurized fluid is located in the gap between the inner wall of the housing and the head of the accumulator piston during the operation of the accumulator module, and such that the guide strip is maintained between the second end of the housing and the pair of connection ducts when the accumulator piston is in contact with the first end of the housing, the pair of connection ducts comprising a first connection duct and a second connection duct that is narrower than the first connection duct, the guide strip fastened to the circumference of the head in between the terminal surface of the head and the at least one pressure-relief groove, the accumulator piston further comprising a single through-bore comprising an axial bore portion and a radial bore portion, the axial bore portion axially traversing into the terminal surface of the head and extending on a longitudinal axis of the accumulator piston, the radial bore portion radially traversing through the circumference of the head and not traversing into the at least one pressure-relief groove, the axial bore portion substantially perpendicular to the radial bore portion and in fluid communication with the axial bore portion, the axial bore portion configured to allow the highly pressurized fluid to flow between a base of the housing and the radial bore portion, the radial bore portion configured to allow the highly pressurized fluid to flow between the axial bore portion and the pair of connection ducts, and the at least one pressure-relief groove positioned in between the guide strip and the radial bore portion, so as to maintain the pressure-relief effect provided by the at least one pressure-relief groove.

* * * * *